US005468602A

United States Patent [19]

Takahashi

[11] Patent Number: 5,468,602

[45] Date of Patent: Nov. 21, 1995

[54] METHOD FOR PRODUCING SILVER HALIDE PHOTOGRAPHIC LIGHT-SENSITIVE MATERIAL

[75] Inventor: Shigeaki Takahashi, Hino, Japan

[73] Assignee: Konica Corporation, Japan

[21] Appl. No.: 333,527

[22] Filed: Nov. 2, 1994

[30] Foreign Application Priority Data

Nov. 10, 1993 [JP] Japan ..... 5-281420

[51] Int. Cl.[6] ..... G03C 1/015; G03C 1/34

[52] U.S. Cl. ..... 430/569; 430/600; 430/603; 430/611; 430/614

[58] Field of Search ..... 430/569, 600, 430/603, 611, 614

[56] References Cited

U.S. PATENT DOCUMENTS

| | | | |
|---|---|---|---|
| 4,224,403 | 9/1980 | Toda et al. | 430/537 |
| 5,059,516 | 10/1991 | Sato et al. | 430/599 |
| 5,153,116 | 10/1992 | Metoki et al. | 430/581 |
| 5,240,824 | 8/1993 | Takada et al. | 430/567 |
| 5,273,871 | 12/1993 | Takada et al. | 420/567 |
| 5,342,741 | 8/1994 | Morimoto et al. | 430/490 |

FOREIGN PATENT DOCUMENTS

| | | | |
|---|---|---|---|
| 367243 | 5/1990 | European Pat. Off. | G03C 1/85 |
| 563708 | 10/1993 | European Pat. Off. | G03C 1/005 |
| 884514 | 12/1961 | United Kingdom | 430/614 |

*Primary Examiner*—Janet C. Baxter

*Attorney, Agent, or Firm*—Jordan B. Bierman; Bierman and Muserlian

[57] ABSTRACT

A method for producing silver halide photographic light-sensitive material is disclosed. The method comprises the steps of (1) forming silver halide crystal nuclei, (2) growing the nuclei to form a silver halide emulsion, (3) chemically sensitizing the silver halide emulsion with a selenium compound, and (4) coating and drying the silver halide emulsion on a support, and a compound represented by formula I is added to the silver halide emulsion during the time between the moment of completion of the nuclei forming step and the moment of completion of the chemically sensitizing step.

(1)

In the formula $R_1$ is a hydrogen atom, a straight or branched alkyl group, a cycloalkyl group, an alkenyl group, an aralkyl group, an alkoxyl group, an aryl group, a heterocyclic group, a carbamoyl group, a thiocarbamoyl group or a sulfamoyl group; $R_2$ and $R_3$ are each independently a hydrogen atom, a halogen atom, an alkyl group, a cycloalkyl group, an aryl group, a cyano group, an alkylthio group, an arylthio group, alkylsulfoxido group, an alkylsulfonyl group or a heterocyclic group, and the groups each represented by $R_2$ and $R_3$ may be combined with each other to form a benzene ring.

11 Claims, 1 Drawing Sheet

METHOD FOR PRODUCING SILVER HALIDE PHOTOGRAPHIC LIGHT-SENSITIVE MATERIAL

FIELD OF THE INVENTION

The present invention relates to a method for manufacturing a silver halide photographic light-sensitive material, and more particularly to a method for manufacturing a silver halide photographic light-sensitive material that is improved so as not to fog when handled in a safelight, said improvement being carried out without lowering the sensitivity thereof.

BACKGROUND OF THE INVENTION

In recent years, there have been more and more diverse demands on silver halide photographic light-sensitive materials. Particularly in the field of X-ray photography, there has been a demand for a silver halide photographic light-sensitive material that is high-speed, high-quality-image-formable and rapidly processable enough to reduce the X-ray exposure dose to the human body so as to enable to rapidly obtain much more plenty of diagnostic information with a smaller amount of X-ray dose than ever before.

As for raising the photographic speed of the light-sensitive material, Japanese Patent Publication Open to Public Inspection (hereinafter abbreviated to JP O.P.I.) Nos. 25832/1992 and 147250/1992 disclose lately a chemical sensitization technique that uses selenium compounds.

The above technique certainly achieves raising the photographic speed, but has a problem of increasing a safelight fog that could occur when handling the light-sensitive material in a safelight.

The safelight for silver halide light-sensitive material is commonly made so as to pass a spectral region of light to which a light-sensitive material to be handled under it is substantially not sensitive. However, some fog is formed when the light-sensitive material is stood under the safelight for a prolonged time, which is called safelight fog by those skilled in the art. It is known that the safelight fogging degree of a light-sensitive material is considerably varied depending on various factors of the manufacturing condition of the light-sensitive material even though the speed and spectral sensitivity of the light-sensitive material seem not to be changed. Of course, a light-sensitive material which forms little or no safelight fog is required.

SUMMARY OF THE INVENTION

It is an object of the present invention to provide a method for producing a silver halide photographic light-sensitive material whose improvement for decreasing its safelight fog is attained without impairing its high sensitivity.

The method of the invention comprises the steps of (1) forming silver halide crystal nuclei, (2) growing said nuclei to form silver halide grains, (3) chemically sensitizing said silver halide grains with a selenium compound, (4) coating said silver halide emulsion on a support, and a compound represented by the following Formula 1 is added to said silver halide emulsion during the time between the moment of completion of said nuclei forming step and the moment of completion of said chemically sensitizing step.

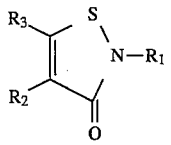

Formula 1 wherein $R_1$ is a hydrogen atom, a straight- or branched-chain alkyl group, a cycloalkyl group, an alkenyl group, an aralkyl group, an alkoxyl group, an aryl group, a heterocyclic group, a carbamoyl group, a thiocarbamoyl group or a sulfamoyl group; $R_2$ and $R_3$ are each independently a hydrogen atom, a halogen atom, an alkyl group, a cycloalkyl group, an aryl group, a cyano group, an alkylthio group, an arylthio group, an alkylsulfoxido group, an alkylsulfonyl group or a heterocyclic group, provided that $R_2$ and $R_3$ may link with each other to form a benzene ring.

DETAILED DESCRIPTION OF THE INVENTION

Figure 1:
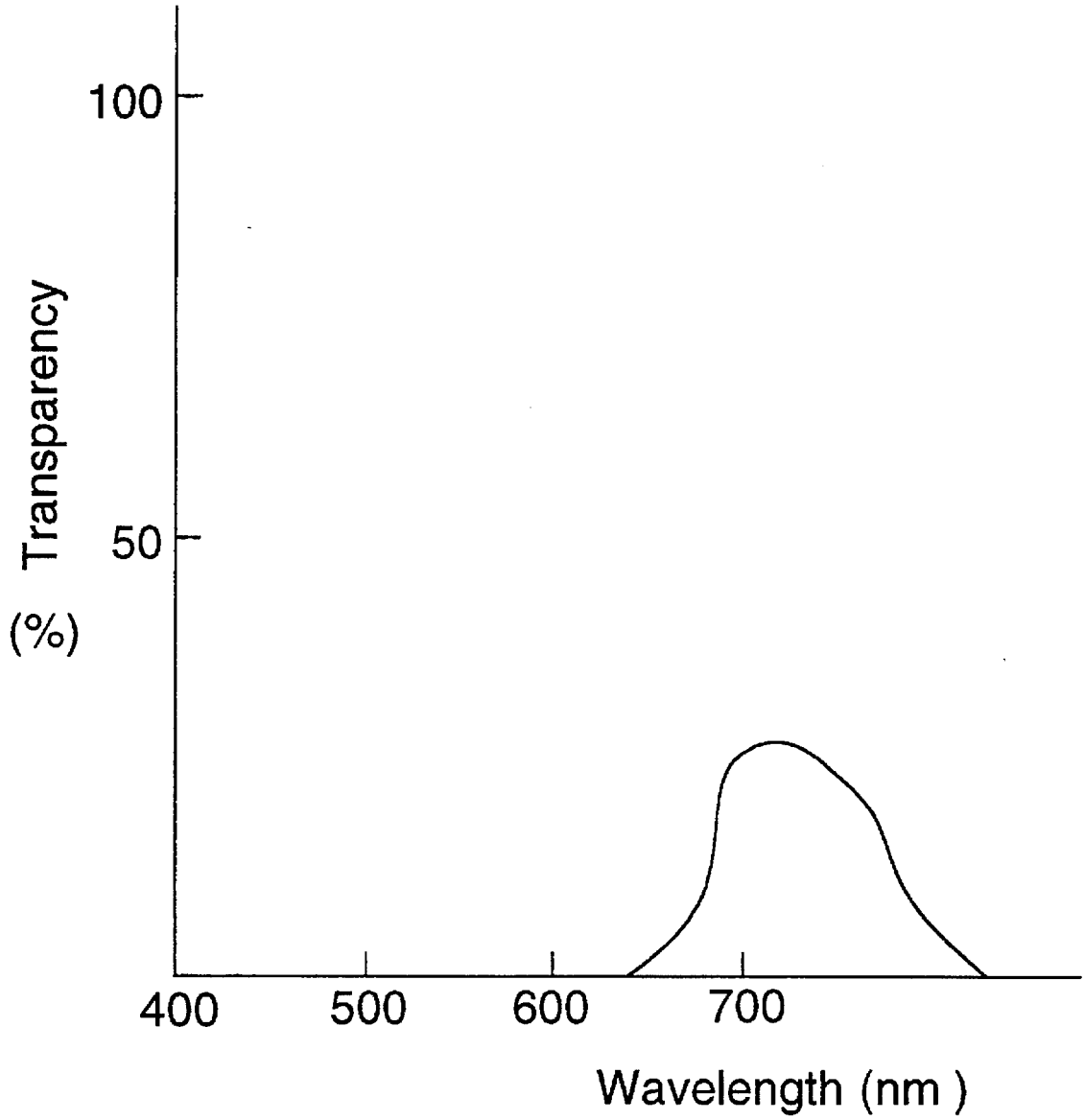
FIG. 1 is a graph showing the spectral transmittance of a red filter that is used in the example described hereinafter.

Firstly, Formula 1 is explained.

In the formula, $R_1$ is a hydrogen atom, a straight-chain or branched-chain alkyl group, a cycloalkyl group, an alkenyl group, an aralkyl group, an alkoxy group, an aryl group, a heterocyclic group, a carbamoyl group, a thiocarbamoyl group or a sulfamoyl group, provided that these groups each may have a substituent; and $R_2$ and $R_3$ group each represent a hydrogen atom, a halogen atom, an alkyl group, a cycloalkyl group, an aryl group, a cyano group, an alkylthio group, an arylthio group, an alkylsulfoxido group, an alkylsulfonyl group or a heterocyclic group, provided that $R_2$ and $R_3$ may combine with each other to form a benzene ring.

Of the above groups, the alkyl, cycloalkyl, alkenyl, aralkyl, alkoxy, aryl, heterocyclic, carbamoyl, thiocarbamoyl and sulfamoyl groups may each have a substituent.

The preferred among the compounds represented by Formula 1 are those represented by Formulas 1a and 1b:

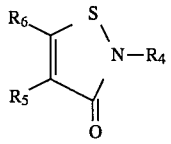

Formula 1a

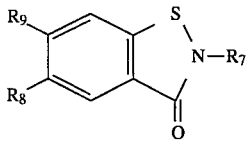

Formula 1b

In Formula 1a, substituents represented by $R_4$ are the same as that represented by $R_1$ in Formula 1; and $R_5$ and $R_6$ are each independently a hydrogen atom, an alkyl group having 1 to 4 carbon atoms, an alkylthio group having 1 to 4 carbon atoms, an arylthio group having 6 to 12 carbon atoms, an alkylsulfoxido group having 1 to 4 carbon atoms, an alkylsulfonyl group having 1 to 4 carbon atoms or a heterocyclic group, and these substituents each may have a substituent.

The following are typical examples of the compound having Formula 1a.

| Compound No. | $R_4$ | $R_5$ | Rhd 6 |
|---|---|---|---|
| 1 | $CONHCH_3$ | H | H |
| 2 | " | " | $CH_3$ |
| 3 | $CSNHCH_3$ | " | H |
| 4 | $CONHCH_3$ | Br | $CH_3$ |
| 5 | " | CN | $SCH_3$ |
| 6 | " | " | $SO_2CH_3$ |
| 7 | " | " | $SC_2CH_3$ |
| 8 | $CONHC_4H_9$ | H | H |
| 9 | $CONHC_8H_{17}$(t) | " | " |
| 10 | CONH— | " | $CH_3$ |
| 11 | " | CN | $SCH_3$ |
| 12 | Cl CONH— | Br | $CH_3$ |
| 13 | " | H | $CH_2Br$ |
| 14 | " | " | $CH_3$ |
| 15 | " | CN | $SCH_3$ |
| 16 | Cl CONH— | H | $CH_3$ |
| 17 | " | " | $CH_2Br$ |
| 18 | Cl CONH— —Cl | Br | $CH_3$ |
| 19 | " | H | " |
| 20 | " | CN | $SCH_3$ |
| 21 | CONH— —$CH_3$ | H | $CH_3$ |
| 22 | CONH— —$CH_3$ | CN | $SCH_3$ |
| 23 | " | Br | $CH_3$ |
| 24 | $CONHC_3H_7$ | H | H |
| 25 | $CONHC_2H_5$ | " | " |
| 26 | $CONHC_3H_7$(i) | " | " |
| 27 | $CONHCH_3$ | Br | " |
| 28 | CONH— —$OCH_3$ | H | " |
| 29 | $OCH_3$ CONH— | " | " |
| 30 | $NO_2$ CONH— | " | " |
| 31 | Cl CONH— —Cl | H | H |
| 32 | $CONHC_{10}H_{21}$ | " | " |

-continued

| Compound No. | $R_4$ | $R_5$ | Rhd 6 |
|---|---|---|---|
| 33 | Cl CONH— Cl | " | " |
| 34 | $CONHCH_2COOC_2H_5$ | " | " |
| 35 | CONH— —$NO_2$ | " | " |
| 36 | $CONHC_2H_5$ | " | $CH_3$ |
| 37 | $CSNHC_2H_5$ | " | " |
| 38 | $CONHC_2H_5$ | H | Cl |
| 39 | $C_3H_7$ | " | H |
| 40 | $C_4H_9$(t) | " | " |
| 41 | $C_4H_9$ | " | " |
| 42 | H | " | " |
| 43 | $C_8H_{17}$(t) | " | " |
| 44 | $OCH_2$— | " | " |
| 45 | $CH_3$ | " | Cl |
| 46 | $CH_2$— | " | " |
| 47 | $CH_3$ | Cl | " |
| 48 | " | $CH_3$ | H |
| 49 | Cl —Cl | " | " |
| 50 | " | H | " |
| 51 | $CH_2$— | Cl | Cl |
| 52 | $CH_3$ | Br | " |
| 53 | " | Br | H |
| 54 | $CH_2OH$ | H | " |
| 55 | $CH_2CH_2N(C_2H_5)_2$ | " | " |
| 56 | $C_3H_7$ | " | H* |
| 57 | $CH_3$ | " | Cl* |
| 58 | $C_2H_5$ | " | H* |
| 59 | $CH_3$ | " | H* |
| 60 | $CH_2$— | H | H* |
| 61 | $C_{12}H_{25}$ | " | " |
| 62 | $C_{14}H_{29}$ | " | " |
| 63 | $CH_2$— —Cl | " | " |
| 64 | Cl $CH_2$— | " | " |

-continued

| Compound No. | $R_4$ | $R_5$ | Rhd 6 |
|---|---|---|---|
| 65 | 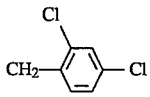 | " | " |
| 66 | 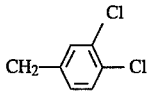 | " | " |
| 67 | 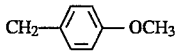 | " | " |
| 68 | 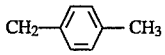 | " | " |
| 69 | $CH_2CHC_4H_9$ \| $OC_2H_5$ | " | " |
| 70 | 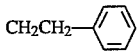 | " | " |
| 71 | " | Cl | " |
| 72 | 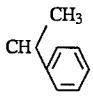 | H | " |
| 73 | $C_{10}H_{21}$ | H | H |
| 74 | $C_8H_{17}$ | " | " |
| 75 | $C_8H_{17}$(t) | Cl | " |
| 76 | " | Br | " |
| 77 | $C_9H_{19}$ | H | " |
| 78 | $C_8H_{17}$ | " | Cl |
| 79 | 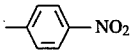 | " | H |
| 80 | 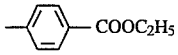 | " | " |
| 81 | $CH_3$ | " | Cl** |
| 82 | " | Cl | Cl** |
| 83 | $C_2H_5$ | H | H** |
| 84 | $C_3H_7$ | " | H** |
| 85 | 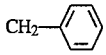 | " | H** |
| 86 | $CONH_2$ | Cl | H |
| 87 | " | H | Cl |
| 88 | $NHSO_2CH_3$ | " | H |
| 89 | 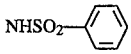 | " | " |
| 90 | 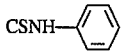 | " | " |
| 91 | $CSNH_2$ | " | " |
| 92 | $CH_3$ | 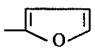 | " |
| 93 | " | $-OSO_2CH_3$ | " |
| 94 | $CONHCH_3$ | 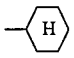 | " |

-continued

| Compound No. | $R_4$ | $R_5$ | Rhd 6 |
|---|---|---|---|
| 95 | " | 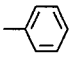 | " |
| 96 | $CONHCH_2OCH_2$— 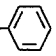 | $CH_3$ | " |

*HCl salt
**$ClCH_2CO_2H$ salt

In Formula 1b, $R_7$ represents the same represented by $R_1$ defined in Formula 1.

$R_8$ and $R_9$ may be the same as or different from each other and each represent a hydrogen atom, an alkyl group having 1 to 4 carbon atoms, an alkoxy group having 1 to 4 carbon atoms, a halogen atom, a nitro group or a cyano group.

The following are typical examples of the compound represented by Formula 1b.

| Compound No. | $R_7$ | $R_8$ | $R_9$ |
|---|---|---|---|
| 97 | H | H | H |
| 98 | $CH_3$ | " | " |
| 99 | $C_2H_5$ | " | " |
| 100 | $C_3H_7$ | " | " |
| 101 | $C_4H_9$ | " | " |
| 102 | (s)$C_4H_9$ | " | " |
| 103 | (t)$C_4H_9$ | " | " |
| 104 | $OCH_3$ | " | " |
| 105 | $OC_2H_5$ | " | " |
| 106 | $OC_3H_7$ | " | " |
| 107 | $OC_4H_9$ | " | " |
| 108 | H | Cl | " |
| 109 | " | $CH_3$ | " |
| 110 | " | H | $CH_3$ |
| 111 | " | CN | H |
| 112 | " | H | $OC_2H_5$ |
| 113 | " | $NO_2$ | H |
| 114 | " | $OCH_3$ | " |
| 115 | 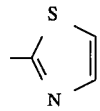 | H | " |
| 116 | H | H | Cl |

Any one of the above compounds of the invention is added to the emulsion of the invention preferably in the form of a solution prepared by dissolving it in a photographically harmless one of organic solvents including water; alcohols such as methanol, ethanol, isopropanol; ketones such as acetone; glycols such as ethylene glycol, propylene glycol; and esters such as ethyl acetate. It is more preferable that the compound of Formula 1 be added to the emulsion together with an emulsion of silver halide fine grains prepared by in advance adding the compound of the invention be added to the emulsion.

The effect of the invention can be enhanced when the compound of Formula 1 is added to the emulsion together with the silver halide fine grains.

The compound of the invention may be added at a discretionary point of time during the period between the moment of completion of the silver halide crystal nuclei formation and the moment of completion of the chemical ripening in the manufacturing process of the silver halide emulsion. In the above, the moment of completion of silver halide crystal nuclei is defined as follows. In the first step of silver halide grain formation, silver ions and halide ions are gradually supplied to a gelatin solution to form silver halide. Silver halide crystal nuclei are precipitated in the solution after the solution is supersaturated by silver halide. Although the number of nuclei is increased accompanied with addition of silver ions and halide ions at the initial stage or the precipitation, the formation of new nuclei is stopped in a short time and the constant number of the nuclei formed before at this time are grown in the solution. The completion of nuclei formation is defined by the time at which the formation of new nuclei is stopped. Concerning the completion of chemical sensitization, as herein-after-mentioned, the chemical sensitization of silver halide emulsion is carried out by holding a silver halide emulsion at a high temperature in the presence of chemical sensitizer. The chemical reaction for sensitization can be stopped by lowering the temperature of the emulsion or adding a ripening stopping agent. The completion of chemical sensitization is defined as the time at which the temperature of the emulsion is made 5° C. lower than the ripening temperature or a ripening stopping agent is added to the emulsion.

The isothiazoline-3-one compound represented by Formula 1a for the invention is used in the amount range of preferably $1\times10^{-4}$ to 100 mg, and more preferably $1\times10^{-2}$ to 10 mg per mol of silver halide.

The 1,2-benzoisothiazoline-3-one compound represented by Formula 1b is used in the amount range of preferably $5\times10^{-4}$ to 50 mg, and more preferably $5\times10^{-3}$ to 5 mg per mol of silver halide. The adding amount may be allowed to be outside the above amount range, depending on the type of silver halide emulsion. The compound of the invention to be added may be a single compound or several kinds of the compound of the invention may be added at the same time.

The compound of the foregoing Formula 1 can be easily synthesized in accordance with the method described in French Patent No. 1,555,416 or equivalent other method.

The silver halide emulsion usable in the invention may be of regular crystal grains, of all isotropically grown crystal grains like octahedral or tetradecahedral crystal grains, of the polyhedral crystal type such as spherical grains, of twin crystal grains or of the mixture or complex type of these different grains, but preferably comprises parallel twin planes-having hexahedral, octahedral, tetradecahedral or tabular silver halide grains. The grain diameter of these silver halide grains is preferably in the range of 0.2 μm to 3.0 μm, and more preferably 0.3 μm to 2.0 μm.

The emulsion usable for the light-sensitive material of the invention can be prepared according to known methods such as, e.g., the method described in Research Disclosure (RD) No.17643 (Dec. 1978), pp.22–23 'Emulsion Preparation and Types,' and the method described in (RD) No.18716 (Nov. 1979), p.648.

The emulsion usable for the light-sensitive material of the invention can also be prepared according to any appropriate one of the methods described in T. H. James, 'The Theory of the Photographic Process,' 4th edition, Macmillan (1977), pp.38–104; G. F. Duffin, 'Photographic Emulsion Chemistry,' Focal Press (1966); P. Glafkides, 'Chimie et Physique Photographique,' Paul Montel (1967); and V. L. Zelikman et al, 'Making And Coating Photographic Emulsion,' Focal Press (1964).

Namely, the emulsion can be prepared according to a method comprised in combination of a liquid condition such as an acidic, ammoniacal or neutral process, a precipitation condition such as a normal, reverse, double-jet or controlled double-jet precipitation process, and a grain preparation condition such as a conversion process or a core/shell-type grain growing process.

The silver halide emulsion, from the standpoint of its silver halide grain diameter distribution, may be either a monodisperse emulsion having a narrow grain diameter distribution or a polydisperse emulsion having a broad grain diameter distribution; both monodisperse and polydisperse emulsions may be used in combination.

The silver halide emulsion may be of monodisperse core/shell-type silver halide grains each having a crystal structure not uniform with difference in the silver halide composition between the inside and the outside thereof, such as a distinct double-phase structure composed of a high silver iodide content core covered with a low silver iodide content shell phase or a tri- or above-phase structure composed of the core covered with plural shell phases different in the silver iodide content.

The silver iodide content of the high-iodide core is preferably 10 to 40 mol %, more preferably 20 to 30 mol %.

The term 'being monodisperse' implies that the value (coefficient of variation) obtained by dividing the variation of grain diameters (standard deviation) by the average grain diameter is preferably not more than 30%, and more preferably 20%.

Methods for preparing such monodisperse emulsions are already known and described in detail in J. Phot. Sci., 12. 242–251, (1963); JP O.P.I. Nos. 36890/1973, 16364/1977, 142329/1980 and 49938/1983; British Patent No. 1,413,748; and U.S. Pat. Nos. 3,574,628 and 3,655,394.

To obtain the above monodisperse emulsion, there may be used an emulsion comprising grains that have been grown from seed crystals as growth nuclei by supplying silver and halide ions thereto.

The method for the preparation of the above core/shell-type emulsion is conventionally known. Examples of the method are found in J. Phot. Sci., 24. 198 (1976); British Patent No. 1,027,146; U.S. Pat. Nos. 3,505,068 and 4,444,877; and JP O.P.I. No. 143331/1985.

The average grain diameter of tabular silver halide grains suitably usable in the invention is preferably 0.3 to 3.0 μm, and more preferably 0.5 to 1.5 μm.

The average (average aspect ratio) of the grain diameter/thickness values (aspect ratios) of the above tabular silver halide grains is preferably not less than 2.0, more preferably 2.0 to 20.0 and most preferably 2.2 to 8.0.

The average thickness of the tabular silver halide grains is preferably not more than 0.5 μm, and more preferably not more than 0.3 μm.

The advantages of the tabular silver halide grain in improving the spectral sensitization efficiency, image graininess and sharpness are disclosed in British Patent No. 2,112,157; U.S. Pat. Nos. 4,439,520, 4,433,048, 4,414,310 and 4,434,226. The emulsion can be prepared according to any appropriate one of the methods described in these publications.

The grain diameter of the tabular silver halide grain is defined as the diameter of a circle equivalent in the area to the projection image of the silver halide grain through electron-microscopic image observation.

The thickness of the silver halide grain is defined as the minimum one of the distances between pairs of parallel planes constituting the tabular silver halide grain; i.e., the distance between the two main surfaces of the crystal grain.

The thickness of the tabular silver halide grain can be found from a electron-microscopic photograph of a shadowy tabular silver halide grain image or of a microtomed cross-sectional image of a dry sample of an emulsion of the tabular silver halide grain coated on a support.

In order to obtain the average aspect ratio, at least 100 grain samples are needed to be provided for the measurement.

In the tabular silver halide emulsion usable in the invention, the tabular silver halide grains account for not less than 50%, more preferably not less than 60% and most preferably not less than 70% of the whole silver halide grains.

The tabular silver halide emulsion preferably used in the invention is a monodisperse one, and more preferably used is one whose grain diameters have a variation coefficient of not more than 20%.

The tabular silver halide emulsion may be of an arbitrary halide composition such as silver chloride, silver bromide, silver iodide, silver chlorobromide, silver iodobromide and the like, but is preferably silver iodobromide from the high sensitivity point of view, and the average silver iodide content of it is preferably 0.1 to 5.0 mol %, and more preferably 0.5 to 3.0 mol %.

The tabular silver halide grain of the emulsion may be either one having thereinside an overall uniform silver halide composition or one in which silver iodide is present locally.

For the preparation of the tabular silver halide emulsion reference can be made to JP O.P.I. Nos. 113926/1983, 113927/1983, 113934/1983 and 1855/1987; and European Patent Nos. 219,849 and 219,850.

For the preparation of the monodisperse tabular silver halide emulsion reference can be made to JP O.P.I. No. 6643/1986.

The preparation of the emulsion comprising tabular silver iodobromide grains having a high aspect ratio can be carried out in the manner that to an aqueous gelatin solution with pBr maintained to be not more than 2 is added an aqueous silver nitrate solution or are added aqueous silver nitrate and halide solutions simultaneously to generate seed crystals, which are then grown according to a double-jet precipitation process.

The size and configuration of the tabular silver halide grain can be controlled by setting up the temperature, silver potential, pH, and the adding speed of both aqueous silver salt and halide solutions at the time of making grain formation.

The average silver iodide content of the tabular silver halide emulsion can be controlled by changing the composition of the aqueous halide solution to be added; i.e., by changing the chloride/bromide/iodide ratio.

In the course of preparing the tabular silver halide emulsion, there may, if necessary, be used a silver halide solvent such as ammonia, thioether, thiourea or the like.

The above-mentioned emulsion may be any one of emulsions of the surface latent image type that forms a latent image on the grain surface, of the internal latent image type that forms a latent image inside the grain and of the type of forming a latent image both on the surface of and inside the grain. To these emulsions may be added during the physical ripening or grain preparation process thereof an iron salt, a cadmium salt, a lead salt, a zinc salt, a thalium salt, a ruthenium salt, an osmium salt, an iridium salt or a complex salt thereof, a rhodium salt or a complex salt thereof, or the like.

The emulsion, to remove the soluble salts therefrom, may be washed according to a noodle washing process or a flocculation sedimentation process. Preferred washing methods include the method that uses a sulfo group-containing aromatic hydrocarbon aldehyde resin described in Japanese Patent Examined Publication (hereinafter abbreviated to JP E.P.) No. 16086/1960, and the method that uses flocculant polymer exemplified compounds G3 or G8 described in JP O.P.I. No. 158644.

The silver halide emulsion of the invention is sensitized by a selenium compound. As the selenium sensitizer any selenium compounds already known by being disclosed in conventional patent publications may be used without restrictions. The sensitization can be carried out by adding a selenium compound to the silver halide emulsion and then by stirring the emulsion for a given period of time at a high temperature, preferably at 40° C. to 90° C.

Selenium sensitizers include unstable-type selenium compounds and/or non-unstable-type selenium compounds.

Examples of the unstable-type selenium compound are the compounds described in JP E.P. Nos. 15748/1969 and 13489/1968; and JP O.P.I. Nos. 25832/1992 and 109240/1992, which include isoselenocyanates such as aliphatic isoselenocyanates like allylisoselenocyanate; selenoureas, selenoketones, selenoamides; selenocarboxylic acids such as 2-selenopropionic acid, 2-selenobutyric acid; selenoesters; diacylselenides such as bis(3-chloro- 2,6-dimethoxybenzoyl)selenide; selenophosphates, phosphinselenides, and colloidal metallic selenium.

The above listed are preferred examples, but unstable selenium compounds are not limited thereto. Regarding the unstable selenium compound as a photographic emulsion sensitizer, it is generally understood that the structure of the compound is not so important to those skilled in the art as long as selenium is unstable; the organic portion of the selenium sensitizer molecule plays nothing more than a role of carrying selenium to make it present in the unstable form in the emulsion. The present invention makes it possible to advantageously use selenium compounds in such a broad idea.

The non-unstable-type selenium compound usable in the invention includes the compounds described in JP E.P. Nos.4553/1971 and 34492/1977; to be concrete, selenious acid, potassium selenocyanate, selenazoles, quaternary salts of selenazoles, diaryl selenide, diaryl diselenide, dialkyl selenide, dialkyl diselenide, 2-selenazolidinedione, 2-selenooxazolidinethione and derivatives thereof. Among these non-unstable-type selenium compounds the preferred are those represented by the following Formulas 2 and 3:

$$Z_1-\overset{\overset{\displaystyle Se}{\|}}{C}-Z_2 \qquad \text{Formula 2}$$

In Formula 2, $Z_1$ and $Z_2$ may be either the same as or different from each other and each represent an alkyl group (e.g., methyl, ethyl, t-butyl, adamantyl, octyl), an alkenyl group (e.g., vinyl, propenyl), an aralkyl group (e.g., benzyl, phenethyl), an aryl group (e.g., phenyl, pentafluorophenyl, 4-chlorophenyl, 3-nitrophenyl, 4-octylsulfamoyl, α-naphthyl), a heterocyclic group (e.g., pyridyl, thienyl, furyl, imidazolyl), $—NR_1(R_2)$, $—OR_3$ or $—SR_4$. $R_1$, $R_2$, $R_3$ and $R_4$ may be either the same as or different from one another and each represent an alkyl group, an aralkyl group, an aryl group or a heterocyclic group. Examples of the alkyl, aralkyl, aryl and heterocyclic groups are the same as those defined for $Z_1$, provided that $R_1$ and $R_2$ each may be a hydrogen atom or an acyl group (e.g., acetyl, propanoyl, benzoyl, heptafluorobutanoyl, difluoroacetyl, 4-nitrobenzoyl, α-naphthoyl, 4-trifluoromethylbenzoyl). In Formula 2, $Z_1$ is preferably an alkyl group, an aryl group or —$NR_1(R_2)$; $Z_2$ is —$NR_5(R_6)$; $R_1$, $R_2$, $R_5$ and $R_6$ may be either the same as or different from one another and each represent a hydrogen atom, an alkyl group, an aryl group or an acyl group. Formula 2 represents more preferably N,N-dialkylselenourea, N,N,N'-trialkyl-N'-acylselenourea, tetraalkylselenourea, N,N-dialkyl-arylselenoamide or N-alkyl-N-aryl-arylselenoamide.

Formula 3

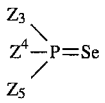

In Formula 3, $Z_3$, $Z_4$ and $Z_5$ may be either the same as or different from one another and each represent an aliphatic group, an aromatic group, a heterocyclic group, —$OR_7$, —$NR_8(R_9)$, —$SR_{10}$, —$SeR_{11}$, X or a hydrogen atom, wherein $R_7$, $R_{10}$ and $R_{11}$ each represent an aliphatic group, an aromatic group, a heterocyclic group, a hydrogen atom or cation, $R_8$ and $R_9$ each represent an aliphatic group, an aromatic group, a heterocyclic group or a hydrogen atom, and X represents a halogen atom. In Formula 3, the aliphatic groups represented by $Z_3$, $Z_4$, $Z_5$, $R_7$, $R_8$, $R_9$, $R_{10}$ and $R_{11}$ are straight-chain, branched-chain or cyclic alkyl, alkenyl, alkynyl and aralkyl groups (e.g., methyl ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, phenethyl). In Formula 3, the aromatic groups represented by $Z_3$, $Z_4$, $Z_5$, $R_7$, $R_8$, $R_9$, $R_{10}$ and $R_{11}$ are monocyclic or condensate ring aryl groups (e.g., phenyl, pentafluorophenyl, 4-chlorophenyl, 3-sulfophenyl, α-naphthyl, 4-methylphenyl).

In Formula 3, the heterocyclic groups represented by $Z_3$, $Z_4$, $Z_5$, $R_7$, $R_8$, $R_9$, $R_{10}$ and $R_{11}$ are saturated or unsaturated 3- to 10-member heterocyclic groups containing at least one of nitrogen, oxygen and sulfur atoms (e.g., pyridyl, thienyl, furyl, thiazolyl, imidazolyl, benzimidazolyl).

In Formula 3, the cation represented by $R_7$, $R_{10}$ or $R_{11}$ is an alkali metal atom or ammonium. The halogen atom represented by X is a fluorine, chlorine, bromine or iodine atom. In Formula 3, $Z_3$, $Z_4$ or $Z_5$ represents preferably an aliphatic group, an aromatic group or —$OR_7$, wherein $R_7$ represents an aliphatic or aromatic group. The compound represented by Formula 3 is preferably a trialkylphosphine selenide, a triarylphosphine selenide, trialkyl selenophosphate or triaryl selenophosphate.

The following are examples of the selenium compounds represented by Formulas 2 and 3, but the invention is not limited thereto.

1

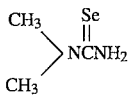

2

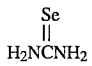

3

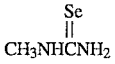

-continued

4

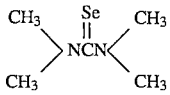

5

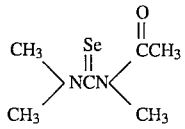

6

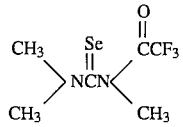

7

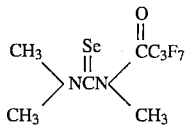

8

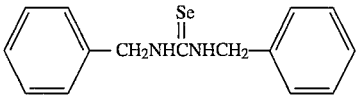

9

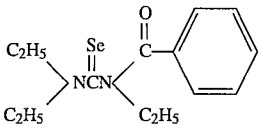

10

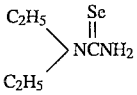

11

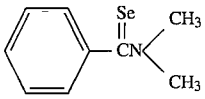

12

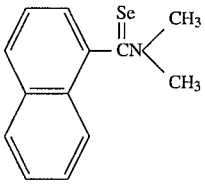

13

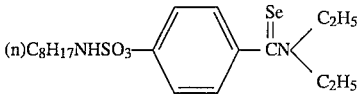

14

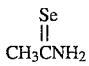

15

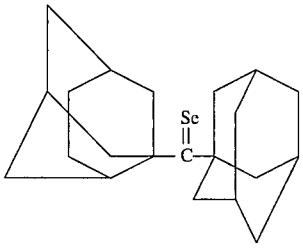

-continued

16 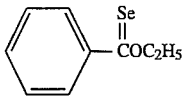

17 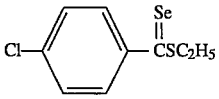

18 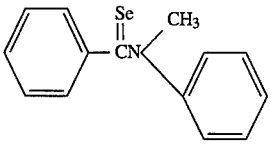

19 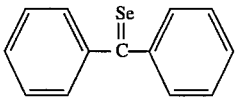

20 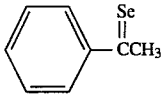

21 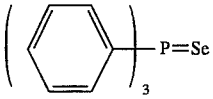

22 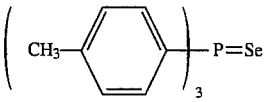

23 $(nC_4H_9)_3P{=}Se$

24 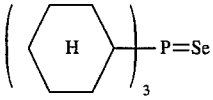

25 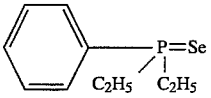

26 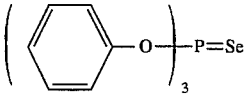

27 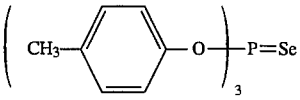

28 $(nC_4H_9O)_3P{=}Se$

29 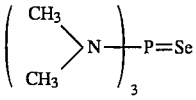

30 $(C_2H_5O)_3P{=}Se$

-continued

31 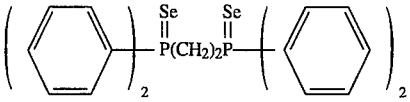

32 $(nC_8H_{17})_3P{=}Se$

33 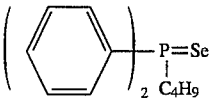

34 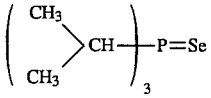

35 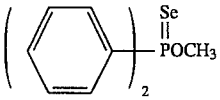

36 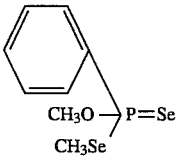

37 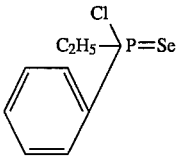

38 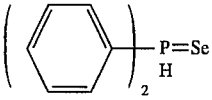

39 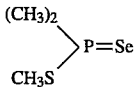

Any one of the above selenium sensitizers, in the form of a solution of it dissolved in water or a single organic solvent or a mixture of organic solvents such as methanol, ethanol, etc., or in the form as described in JP O.P.I. Nos. 140738/1992 and 140739/1992, is added to the silver halide emulsion at the time of its chemical sensitization. The selenium sensitizer used is not limited to single; two or more kinds of it can be used in combination. Both unstable and non-unstable selenium compounds can of course be used in combination. The adding amount of the selenium compound used in the invention, although dependent upon the activity of the selenium compound used, the kind and size of the silver halide used and the temperature and time of the ripening thereof, is preferably not less than $1\times10^{-8}$ mol, more preferably $1\times10^{-7}$ to $1\times10^{-5}$ mol per mol of silver halide. The chemical ripening temperature in the case of using the selenium compound is preferably 40° C. to 90° C. pAg and pH are discretionary. The effect of the invention can be achieved in as much wide a pH range as 4 to 9.

The selenium sensitizer can be more effective when used in the presence of a silver halide solvent.

The silver halide solvent usable in the emulsion includes (a) the organic thioethers described in U.S. Pat. Nos. 3,271,157, 3,531,289 and 3,574,628; JP O.P.I. Nos. 1019/1979 and 158917/1979, (b) the thiourea derivatives described in JP O.P.I. Nos. 82408/1978, 77737/1980 and 2982/1980, (c) the silver halide solvent having a thiocarbonyl group put between an oxygen or sulfur atom and a nitrogen atom described in JP O.P.I. No. 144319/1978, (d) the imidazoles described in JP O.P.I. No. 100717/1979, (e) sulfites and (f) thiocyanates. Among these silver halide solvents the most preferred are a thiocyanate and a tetramethylthiourea. The using amount of the silver halide solvent depends on the kind of it used, but in the case of a thiocyanate, is not less than $1\times10^{-4}$ mol and not more than $1\times10^{-2}$ mol per mol of silver halide.

The chemical sensitization of the silver halide photographic emulsion of the invention may be conducted in combination with sulfur sensitization and/or gold sensitization. The sulfur sensitization is conducted usually in the manner that the emulsion, after adding a sulfur sensitizer thereto, is stirred for a given period of time at a high temperature, preferably at 40° C. to 90° C. The gold sensitization is carried out usually by adding a gold sensitizer to the emulsion and by stirring the emulsion for a certain period at a high temperature, preferably at 40° C. to 90° C. For the above sulfur sensitization there may be used known sulfur compounds, which include thiosulfates, thioureas, allylisocyanate, cystine, p-toluenethiosulfonates and rhodanine, and also include the sulfur sensitizers described in U.S. Pat. Nos. 1,574,944, 2,410,689, 2,278,947, 2,728,668, 3,501,313 and 3,656,955; German Patent No. 1,422,869; JP E.P. No. 24937/1981 and JP O.P.I. No. 45016/1980. The sulfur sensitizer is used in an amount enough to effectively increase the sensitivity of the emulsion. The required adding amount largely varies under various conditions of the pH, temperature, silver halide grain size, etc., of the emulsion, but is preferably not less than $1\times10^{-7}$ mol and not more than $5\times10^{-4}$ mol per mol of silver halide.

The above gold sensitizer used for the gold sensitiztion may be of an oxidation number of either +1 or +3 and may be any one of gold compounds usually used as the gold sensitizer. Typical examples of the gold sensitizer include chloroaurates, potassium chloroaurate, auric trichloride, potassium auricthiocyanate, potassium iodoaurate, tetracyanoauric acid, ammonium aurothiocyanate and pyridyltrichlorogold. The adding amount of the gold sensitizer varies according to various conditions, but is preferably not less than $1\times10^{-7}$ mol and not more than $5\times10^{-4}$ mol per mol of silver halide.

In the case of using a sulfur sensitizer and/or a gold sensitizer together with the selenium sensitizer, there are no specific restrictions on the point of time of adding the sulfur sensitizer and/or gold sensitizer as well as on the adding order of the selenium sensitizer, silver halide solvent, sulfur sensitizer and gold sensitizer; for example, in the initial stage of the chemical ripening or while the chemical ripening is in progress, the sulfur sensitizer and/or gold sensitizer can be added either simultaneously with or at a different point of time than the selenium sensitizer and silver halide solvent. The above sulfur sensitizer and/or gold sensitizer may be added in the form of a solution thereof dissolved in water or in a single one of or a mixture of water-miscible organic solvents such as methanol, ethanol and acetone to be added to the emulsion.

The ripening temperature of the emulsion in the invention may be determined discretionarily, but is preferably 40° to 90° C.

Types of the fine-grained silver halide preferably to be added to the emulsion together with a compound of Formula 1 include AgBr, AgI, AgClBr, AgBrI, AgClI and AgClBrI, but a fine-grained silver halide which has substantially no sensitivity is preferred.

The grain diameter of the above fine-grained silver halide is preferably not more than 0.1 μm, more preferably not more than 0.07 μm and most preferably not more than 0.05 μm.

Suitably usable as the fine-grained silver halide is fine-grained silver iodide.

Regarding silver iodide, there are generally known cubic-system γ-AgI and hexagonal-system β-AgI. The crystal structure of the fine-grained silver iodide used in the invention may be either of the above crystal systems, or may also be a mixture of them.

In the case where silver bromide or silver chloride in the form of a solid solution principally of the rock salt structure is used as the fine-grained silver halide; i.e., where a fine-grained silver iodide such as, e.g., $AgBr_{0.9}I_{0.1}$ is used, the fine grain thereof is preferably either a regular crystal having substantially no twin planes or a single-twin crystal having one twin plane alone.

The fine-grained silver halide preferably used in the process of the invention is preferably satisfactorily monodisperse and its preparation is preferably made according to a double-jet precipitation process with its temperature, pH and pAg being controlled.

The adding amount of the fine-grained silver halide, where the average grain diameter of the parent grain emulsion is designated as d(μm), is preferably not more than 1/100d mol, more preferably 1/20000d to 1/300d mol, and most preferably 1/5000d to 1/500d mol per mol of silver halide contained in the emulsion to which the fine-grained silver halide is to be added. The temperature of the emulsion when adding the fine-grained silver halide is preferably in the range of 30° to 80° C., and more preferably 40° to 65° C. The fine-grained silver halide is added together with a compound of Formula 1 to the emulsion at a discretionary point of time in the course between the completion of the nucleus formation and the completion of the chemical sensitization of the emulsion.

In the invention, in order to stop the chemical sensitization (chemical ripening), when taking into account the stability of the emulsion, it is preferable to use a chemical ripening stopping agent. Compounds which can be used as the chemical sensitization or chemical ripening stopping agent include halides such as potassium bromide and sodium chloride, and organic compounds known as antifoggants or stabilizers including azoles such as benzothiazolium salts, nitroimidazoles, nitrobenzimidazoles, chlorobenzimidazoles, bromobenzimidazoles; nitroindazoles, benzotriazoles and aminotriazoles; mercapto compounds such as mercaptobenzimidazoles, mercaptothiadiazoles, mercaptotetrazoles, mercaptopyrimidines, mercaptotriazines; thioketo compounds such as oxadolinethion; azaindenes such as triazazindenes, tetraazaindenes, particularly 4-hydroxy-substituted-(1,3,3 a,7)tetrazaindenes, and pentaazaindenes; benzenethiosulfonic acid, benzenesulfinic acid and benzenesulfonamide. When the ripening stopping agent is used, the moment of completion of chemical sensitization in the invention is defined as the moment at which the chemical sensitization stopping agent is added to the emulsion being subjected to chemical sensitization.

The emulsion prepared by the method of the invention may have various photographic additives added thereto in a process before or after its physical ripening or chemimal ripening process. Known additives are described in Research Disclosure (RD) NOS. 17643 (Dec. 1978), 18716 (Nov. 1979) and 308119 (Dec. 1989). In these three publications the relavant pages and sections to compounds as photographic additives are as follows:

| | RD-17643 | | RD-18716 | | RD-308119 | |
|---|---|---|---|---|---|---|
| Additive | Page | Sec. | Page | Sec. | Page | Sec. |
| Chemical sensitizers | 23 | III | 648 | upper right | 996 | III |
| Sensitizing dyes | 23 | IV | 648–649 | | 996–8 | IVA |
| Desensitizing dyes | 23 | IV | | | 998 | IVB |
| Dyes | 25–26 | VIII | 649–650 | | 1003 | VIII |
| Development accelerators | 29 | XXI | 648 | upper right | | |
| Antifoggants, stabilizers | 24 | IV | 649 | upper right | 1006–7 | VI |
| Brightening agents | 24 | V | | | 998 | V |
| Hardeners | 26 | X | 651 | Left | 1004–5 | X |
| Surfactants | 26–7 | XI | 650 | right | 1005–6 | XI |
| Antistatic agents | 27 | XII | 650 | right | 1006–7 | XIII |
| Plasticizers | 27 | XII | 650 | right | 1006 | XII |
| Sliding agents | 27 | XII | | | | |
| Matting agents | 28 | XVI | 650 | right | 1008–9 | XVI |
| Binders | 26 | XXII | | | 1003–4 | IX |
| Support materials | 28 | XVII | | | 1009 | XVII |

Materials usable as the support for the light-sensitive material of the invention include those as described in the aforementioned RD-17643, p.28, and RD-308119, p.1009.

The most suitable as the support is a polyethylene terephthalate film. The surface of the support, in order to improve its adhesion property to a coated layer, may be subjected to subbing treatment, corona-discharge treatment, UV-radiation treatment or the like.

EXAMPLES

EXAMPLE 1

Preparation of a seed emulsion

The following solutions were used to prepare a seed emulsion of silver bromide.

| | |
|---|---|
| Solution $A_1$ | |
| Osein gelatin treated with hydrogen peroxide | 40 g |
| Potassium bromide | 23.7 g |
| $HO(CH_2CH_2O)m(CH(CH_3)CH_2O)_{17}(CH_2CH_2O)nH$ (m + n = 5.7) 10% methanol solution | 10 ml |
| Water to make | 4000 ml |
| Solution $B_1$ | |
| Silver nitrate | 600 g |
| Water to make | 803 ml |
| Solution $C_1$ | |
| Osein gelatin treated with hydrogen peroxide | 16.1 g |
| Potassium bromide | 420 g |
| Water to make | 803 ml |
| Solution $D_1$ | |
| Ammonia water (28%) | 235 ml |

A device of the type disclosed in JP O.P.I. No. 160128/1987 was used and arranged so that its mixing stirrer blades have thereunderneath 6 supply nozzles for each of Solutions $B_1$ and $C_1$.

To Solution $A_1$ with high-speed stirring at 430 rpm at 40° C. were added Solutions $B_1$ and $C_1$ at a flow rate of 62.8 ml/min according to a controlled double-jet precipitation method. The flow rate was gradually raised 4 minutes and 46 seconds after the commencement of the addition, and the final flow rate reached 105 ml/min. The total adding period of time was 10 minutes and 45 seconds. A potassium bromide solution (3.5N) was used to maintain pBr at 1.3 during the addition.

After completion of the addition, the temperature of the mixed solution was lowered linearly to 20° C. in 105 minutes, and Solution $D_1$ was added thereto in 20 seconds with the number of stirring revolutions changed to 460 rpm, whereby five-minute Ostwald ripening took place. The bromine ion concentration during the ripening time was 0.025 mol/liter, the ammonia concentration was 0.63 mol/liter, and pH was 11.7.

Immediately after that, acetic acid was added to the liquid until its pH comes to 5.6 to neutralize it to thereby stop its ripening, and to remove the excessive salts therefrom, an aqueous solution of Demol N, produced by Kao Atlas Co., and an aqueous solution of magnesium sulfate were used to precipitate the emulsion. Five minutes later, the supernatant was decanted off to subject the emulsion to desalting/whashing treatment. Subsequently, the emulsion, after adding an aqueous 10% additional gelatin solution (1) thereto was continuously stirred at 50° C. for 30 minutes for redispersion. The obtained emulsion was designated as seed emulsion Em-0.

Seed emulsion Em-0 was observed through an electron microscope. As a result, it was found that the emulsion was comprised of parallel twin planes-having spherical-type twin crystal grains of which the average grain diameter was 0.24 μm and the grain diameters' variation coefficient was 17%.

Growth of seed emulsion

The seed emulsion Em-0 and the following three different solutions were used to prepare a silver halide emulsion.

| | |
|---|---|
| Solution $A_2$ | |
| Osein gelatin | 114.5 g |
| $HO(CH_2CH_2O)m(CH(CH_3)CH_2O)_{17}(CH_2CH_2O)nH$ (m + n = 5.7) 10% methanol solution | 40 ml |
| Water to make | 10330 ml |
| Solution $B_2$ | |
| Osein gelatin | 29.8 g |
| Potassium bromide | 1893.5 g |
| Potassium bromide | 40.5 g |
| Water to make | 5430 ml |
| Solution $C_2$ | |
| Silver nitrate | 2634 g |
| Water to make | 5430 ml |
| Seed emulsion Em–0 | equivalent to 1.09 mol |

To Solution $A_2$ with vigorously stirring at 65° C. the seed emulsion Em-0 was added and well dispersed therein, and to the mixture were added Solutions $B_2$ and $C_2$ in 40 minutes according to a controlled double-jet precipitation process, during which pH was linearly controlled to 5.8, while pAg was consistently maintained at 9.9. The adding speed of Solutions $B_2$ and $C_2$ was linearly increased so that the final speed at the end of the addition is 2.3 times the speed at the start of the addition.

Upon completion of the addition, pH was adjusted to 6.0 with acetic acid, and the emulsion was subjected to desalting treatment in the same manner as in the previous description to remove the excessive salts therefrom.

Next, for redispersion, to the emulsion, with stirring at 50° C., an aqueous 10% additional gelatin solution (2) was added and the mixture was continuously stirred for 30 minutes for redispersion. This emulsion was designated as Em-1.

The obtained emulsion was observed through an electron microscope. As a result, it was found that the emulsion was of tabular crystal grains with hexagonal principal planes having an average grain diameter of 1.80 μm, an average thickness of 0.72 μm, an average aspect ratio of 2.5, a grain diameter variation coefficient of 19%. The grain had a (111) face as its principal plane and also had a (100) face.

Preparation of emulsion of fine-grained silver halide (Preparation of emulsion of fine-grained silver iodide)

To 5000 ml of an aqueous 2 wt % gelatin solution containing 0.008 mol potassium iodide were added 1500 ml of an aqueous 1.06 mol silver nitrate solution and 1500 ml of an aqueous 1.06 mol potassium iodide solution at a fixed flow rate, spending 35 minutes, during which the temperature was maintained at 40° C. The obtained silver halide fine grains had an average grain diameter of 0.043 μm and was a mixture of β-AgI and γ-AgI.

(Chemical sensitization of emulsion Em-1)

To the obtained emulsion Em-1, with stirring at 55° C., the following sensitizing dyes A and B were added in amounts of 200 mg and 14 mg, respectively, per mol of silver halide, and 10 minutes later, 60 mg/mol Ag of ammonium thiocyanate, 1.45 mg/mol Ag of chloroauric acid and the following amounts of sodium thiosulfate and selenium sensitizer N,N-dimethylselenourea were added all as chemical sensitizers to the emulsion, whereby the chemical sensitization of the emulsion was carried out. Further 30 minutes later, the above fine-grained silver iodide in an amount of $2.0\times10^{-3}$ mol per mol of silver was added, and then 4-hydroxy-6-methyl-1,2,3,7-tetrazaindene in an amount of $2\times10^{-2}$ mol per mol of silver was added to thereby stabilize the emulsion, whereby emulsions E-1-1 to E-1-4 as given below were obtained.

| Emulsion | Sodium thiosulfate | N,N-dimethylselenourea |
|---|---|---|
| E-1-1 | 3.3 mg | — |
| E-1-2 | 2.0 mg | 2.8 mg |
| E-1-3 | 1.3 mg | 4.3 mg |
| E-1-4 | — | 7.1 mg |

Sensitizing dye A:

Sodium 5',5-dichloro-9-ethyl-3,3'-di-(3-sulfopropyl)oxacarbocyanine

Sensitizing dye B:

Sodium 5',5-di-(butoxycarbonyl)-1,1'-diethyl-3,3'-di-(4-sulfobutyl)-benzimidazolocarbocyanine (Preparation of samples)

To each of the obtained emulsions the following additives were added to prepare emulsion coating solutions. At the same time a protective layer coating solution also was prepared. The additives that were used are as follows, wherein the adding amount of each additive is a weight per mol of silver halide.

| | |
|---|---|
| 1,1-Dimethylol-1-bromo-1-nitromethane | 70 mg |
| t-Butyl-catechol | 400 mg |
| Polyvinylpyrrolidone (Mw: 10,000) | 1.0 g |
| Styrene-maleic anhydride copolymer | 2.5 g |
| p-Nitrophenyl-triphenylphosphonium chloride | 50 mg |
| Ammonium resorcinol-4-sulfonate | 2 g |
| Sodium 2-mercaptobenzimidazole-5-sulfonate | 1.5 g |
| $C_4H_9OCH_2CH(OH)CH_2N(CH_2COOH)_2$ | 1 g |
| 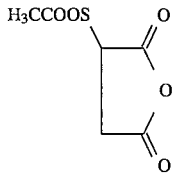 | 7.2 mg |
| 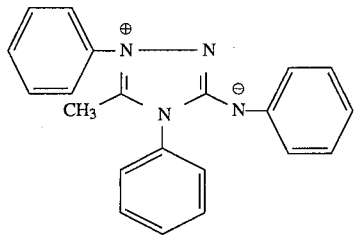 | 150 mg |
| 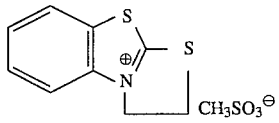 | 30 mg |

-continued

| | |
|---|---|
| 1-Phenyl-5-mercaptotetrazole | 15 mg |

Next, a protective layer coating solution containing the following additives was prepared, wherein the amount of each additive is a weight per liter of the coating solution.

| | |
|---|---|
| Sodium i-amyl-n-decylsulfosuccinate | 1.0 g |
| Polymethyl methacrylate (matting agent: area average particle size: 3.5 μm) | 1.1 g |
| Silicon dioxide particles (matting agent: area average particle size: 1.2 μm) | 0.5 g |
| Ludox AM (colloidal silica, produced by DuPont Co.) | 30 g |
| Di-(vinylsulfonylmethyl)ether | 500 mg |
| $C_4F_9SO_3K$ | 2.0 mg |
| $C_{12}H_{25}CONH(CH_2CH_2O)_5H$ | 2.0 g |
| 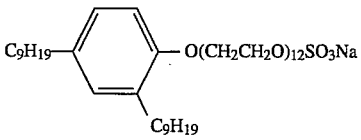 | 12 mg |
| 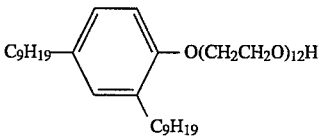 | 2 mg |
| $NaO_3S-CH(CH_2COOCH_2(C_2F_4)_3H)COOCH_2(C_2F_4)_3H$ | 5 mg |
| 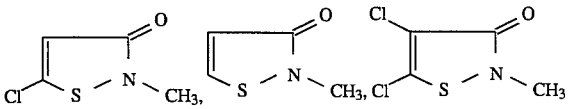 (50:46:4) | 0.73 mg |
| $C_9F_{19}O(CH_2CH_2O)_{10}CH_2CH_2OH$ | 3 mg |
| 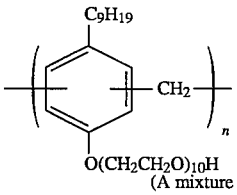 (A mixture of compounds composed of n = 2 to 5 units) | 15 mg |

The above coating solutions were coated by using a slide-hopper-type coater on both sides of the support so as to have a silver coating weight of 1.9 g/m$^2$ per side and a gelatin coating weight of 3.0 g/m$^2$ per side of the support, and then the coated layers were dried in 2 minutes and 20 seconds, whereby light-sensitive material samples No.1 to No.88 were prepared.

(Evaluation of the samples)

(1) Sensitometry (evaluation of photographic characteristics)

Sensitometry tests were conducted in the manner that each sample piece was sandwiched by a pair of intensifying screen sheets KO-250, produced by KONICA Corporation, and was exposed through a Petrometer B to X-rays.

Then, the exposed samples were each processed at 35° C. for 45 seconds by using a roller-transport-type automatic processor SRX-501, a developer XD-SR and a fixer XF-SR (all manufactured by KONICA Corp.). The sensitivity was expressed as the reciprocal of an exposure amount necessary to give a fog+0.1 density, and the results of the samples are shown in relative speeds to the sensitivity of Sample No.1 set at 100.

(2) Evaluation of safelight

Each unexposed sample was developed under the same conditions as in the above (1); exposed for 30 minutes through a red filter having the transmittance shown in FIG. 1 to the light of an incandescent lamp placed above at a distance of 1.2 meters therefrom; and then again subjected to processing in the same manner as in the above, whereby the increased degree of the fog density of each sample was examined.

The obtained results are shown in Tables 1 and 2, wherein the samples prepared by adding the compound of Formula 1 to additional gelatin solutions (1) and (2) and those prepared by adding the same to the fine-grained emulsion to be added in the chemical sensitization process were designated as the samples for the invention, while those prepared by adding the same to the protective layer coating solution before coating were designated as comparative samples.

In Table 1, the 4th column, Gelatin (1), Gelatin (2), AgI fine grain and Protect layer each represent that the compound of Formula 1 is added to additional gelatin solution (1) to be added to Emulsion-0 for redispersion, additional gelatin solution (2) to be added to Emulsion-1 for redispersion, emulsion of AgI fine grain to be added to Emulsion-1 at the time of chemical sensitization, and to the protective layer coating solution, respectively.

TABLE 1

| Sample No. | Em No. | Compound Formula 1 | Solution cpd added to | Added amt (mg/mol Ag) | Speed | Safelight fog |
|---|---|---|---|---|---|---|
| 1 (Comp.) | E-1-1 | None | — | — | 100 | 0.22 |
| 2 (Comp.) | " | No. 47 | Gelatin (1) | 0.8 | 97 | 0.22 |
| 3 (Comp.) | " | " | Gelatin (2) | " | 92 | 0.20 |
| 4 (Comp.) | " | " | AgI fine grain | " | 101 | 0.21 |
| 5 (Comp.) | " | " | Protect layer | " | 102 | 0.22 |
| 6 (Comp.) | " | " | Gelatin (1) | 6 | 90 | 0.19 |
| 7 (Comp.) | " | " | Gelatin (2) | " | 88 | 0.19 |
| 8 (Comp.) | " | " | AgI fine grain | " | 94 | 0.21 |
| 9 (Comp.) | " | " | Protect layer | " | 99 | 0.22 |
| 10 (Comp.) | " | No. 57 | Gelatin (1) | 0.8 | 95 | 0.20 |
| 11 (Comp.) | " | " | Gelatin (2) | " | 95 | 0.19 |
| 12 (Comp.) | " | " | AgI fine grain | " | 97 | 0.20 |
| 13 (Comp.) | " | " | Protect layer | " | 100 | 0.20 |
| 14 (Comp.) | " | " | Gelatin (1) | 6 | 95 | 0.22 |
| 15 (Comp.) | " | " | Gelatin (2) | " | 90 | 0.21 |
| 16 (Comp.) | " | " | AgI fine grain | " | 96 | 0.22 |
| 17 (Comp.) | " | " | Protect layer | " | 99 | 0.21 |
| 18 (Comp.) | E-1-2 | None | — | — | 134 | 0.53 |
| 19 (Inv.) | " | No. 47 | Gelatin (1) | 0.8 | 133 | 0.18 |
| 20 (Inv.) | " | " | Gelatin (2) | " | 135 | 0.24 |
| 21 (Inv.) | " | " | AgI fine grain | " | 134 | 0.22 |
| 22 (comp.) | " | " | Protect layer | " | 135 | 0.47 |
| 23 (Inv.) | " | " | Gelatin (1) | 6 | 134 | 0.19 |
| 24 (Inv.) | " | " | Gelatin (2) | " | 133 | 0.19 |
| 25 (Inv.) | " | " | AgI fine grain | " | 130 | 0.17 |
| 26 (Comp.) | " | " | Protect layer | " | 133 | 0.48 |
| 27 (Inv.) | " | No. 57 | Gelatin (1) | 0.8 | 130 | 0.21 |
| 28 (Inv.) | " | " | Gelatin (2) | " | 132 | 0.25 |
| 29 (Inv.) | " | " | AgI fine grain | " | 130 | 0.23 |
| 30 (Comp.) | " | " | Protect layer | " | 134 | 0.51 |
| 31 (Inv.) | " | " | Gelatin (1) | 6 | 130 | 0.22 |
| 32 (Inv.) | " | " | Gelatin (2) | " | 130 | 0.20 |
| 33 (Inv.) | " | " | AgI fine grain | " | 131 | 0.18 |
| 34 (Comp.) | " | " | Protect layer | " | 133 | 0.50 |
| 35 (Inv.) | " | No. 108 | Gelatin (1) | 0.8 | 135 | 0.23 |
| 36 (Inv.) | " | " | Gelatin (2) | " | 133 | 0.23 |
| 37 (Inv.) | " | " | AgI fine grain | " | 131 | 0.20 |
| 38 (Comp.) | " | " | Protect layer | " | 132 | 0.48 |
| 39 (Inv.) | " | " | Gelatin (1) | 6 | 132 | 0.21 |
| 40 (Inv.) | " | " | Gelatin (2) | " | 132 | 0.23 |
| 41 (Inv.) | " | " | AgI fine grain | " | 130 | 0.20 |
| 42 (Inv.) | " | " | Protect layer | " | 135 | 0.48 |
| 43 (Comp.) | E-1-3 | None | — | — | 144 | 0.63 |
| 44 (Inv.) | " | No. 47 | Gelatin (1) | 0.8 | 143 | 0.25 |
| 45 (Inv.) | " | " | Gelatin (2) | " | 141 | 0.23 |
| 46 (Inv.) | " | " | AgI fine grain | – | 140 | 0.21 |
| 47 (Comp.) | " | " | Protect layer | " | 143 | 0.61 |
| 48 (Inv.) | " | " | Gelatin (1) | 6 | 140 | 0.23 |
| 49 (Inv.) | " | " | Gelatin (2) | " | 141 | 0.22 |
| 50 (Inv.) | " | " | AgI fine grain | " | 139 | 0.20 |
| 51 (Comp.) | " | " | Protect layer | " | 143 | 0.61 |
| 52 (Inv.) | " | No. 57 | Gelatin (1) | 0.8 | 141 | 0.25 |
| 53 (Inv.) | " | " | Gelatin (2) | " | 140 | 0.24 |
| 54 (Inv.) | " | " | AgI fine grain | " | 139 | 0.22 |
| 55 (Comp.) | " | " | Protect layer | " | 142 | 0.60 |
| 56 (Inv.) | " | " | Gelatin (1) | 6 | 140 | 0.24 |
| 57 (Inv.) | " | " | Gelatin (2) | " | 139 | 0.24 |
| 58 (Inv.) | " | " | AgI fine grain | " | 137 | 0.22 |
| 59 (Comp.) | " | " | Protect layer | " | 140 | 0.61 |
| 60 (Inv.) | " | No. 108 | Gelatin (1) | 0.8 | 144 | 0.22 |
| 61 (Inv.) | " | " | Gelatin (2) | " | 142 | 0.20 |
| 62 (Inv.) | " | " | AgI fine grain | " | 142 | 0.19 |
| 63 (Comp.) | " | " | Protect layer | " | 144 | 0.63 |
| 64 (Inv.) | " | " | Gelatin (1) | 6 | 142 | 0.20 |
| 65 (Inv.) | " | " | Gelatin (2) | " | 140 | 0.20 |

TABLE 1-continued

| Sample No. | Em No. | Compound Formula 1 | Solution cpd added to | Added amt (mg/mol Ag) | Speed | Safelight fog |
|---|---|---|---|---|---|---|
| 66 (Inv.) | " | " | AgI fine grain | " | 140 | 0.17 |
| 67 (Comp.) | " | " | Protect layer | " | 143 | 0.60 |
| 68 (Comp.) | E-1-4 | None | — | — | 151 | 0.66 |
| 69 (Inv.) | " | No. 47 | Gelatin (1) | 0.8 | 149 | 0.24 |
| 70 (Inv.) | " | " | Gelatin (2) | " | 145 | 0.24 |
| 71 (Inv.) | " | " | AgI fine grain | " | 144 | 0.23 |
| 72 (Comp.) | " | " | Protect layer | " | 149 | 0.63 |
| 73 (Inv.) | " | " | Gelatin (1) | 6 | 149 | 0.22 |
| 74 (Inv.) | " | " | Gelatin (2) | " | 145 | 0.22 |
| 75 (Inv.) | " | " | AgI fine grain | " | 144 | 0.21 |
| 76 (Comp.) | " | " | Protect layer | " | 148 | 0.62 |
| 77 (Inv.) | " | No. 57 | Gelatin (1) | 0.8 | 146 | 0.23 |
| 78 (Inv.) | " | " | Gelatin (2) | " | 144 | 0.23 |
| 79 (Inv.) | " | " | AgI fine grain | " | 144 | 0.22 |
| 80 (Comp.) | " | " | Protect layer | " | 148 | 0.65 |
| 81 (Inv.) | " | " | Gelatin (1) | 6 | 145 | 0.23 |
| 82 (Inv.) | " | " | Gelatin (2) | " | 143 | 0.20 |
| 83 (Inv.) | " | " | AgI fine grain | " | 144 | 0.21 |
| 84 (Comp.) | E-1-4 | No. 57 | Protect layer | 6 | 147 | 0.66 |
| 85 (Inv.) | " | No. 108 | Gelatin (1) | 0.8 | 150 | 0.24 |
| 86 (Inv.) | " | " | Gelatin (2) | " | 146 | 0.20 |
| 87 (Inv.) | " | " | AgI fine grain | " | 145 | 0.19 |
| 88 (Comp.) | " | " | Protect layer | 151 | 0.66 | |

From the results shown in Table 1, it is apparent that the safelight fog of each of the samples of the invention is largely decreased without lowering of its sensitivity as compared to the comparative samples.

What is claimed is:

1. A method for producing a silver halide photographic light-sensitive material comprising the steps of forming silver halide crystal nuclei, growing said nuclei to form a silver halide emulsion, chemically sensitizing said silver halide emulsion with a selenium compound, and coating and drying said silver halide emulsion on a support, wherein a compound represented by formula I is added to said silver halide emulsion during the time between the moment of completion of said nuclei forming step and the moment of completion of said chemically sensitizing step,

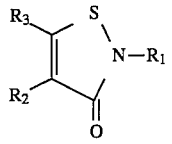

(1)

wherein $R_1$ is a hydrogen atom, a straight chain or branched chain alkyl group, a cycloalkyl group, an alkenyl group, an aralkyl group, an alkoxyl group, an aryl group, a heterocyclic group, a carbamoyl group, a thiocarbamoyl group or a sulfamoyl group; $R_2$ and $R_3$ are each independently a hydrogen atom, a halogen atom, an alkyl group, a cycloalkyl group, an aryl group, a cyano group, an alkylthio group, an arylthio group, alkylsulfoxido group, an alkylsulfonyl group or a heterocyclic group, and the groups each represented by $R_2$ and $R_3$ may be combined with each other to form a benzene ring.

2. The method of claim 1, wherein said compound represented by formula 1 is a compound represented by formula 1a,

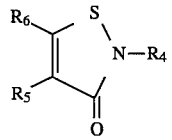

(1a)

wherein $R_4$ is the same as $R_1$ defined in Formula 1; and $R_5$ and $R_6$ are each independently a hydrogen atom, an alkyl group having 1 to 4 carbon atoms, an alkylthio group having 1 to 4 carbon atoms, an arylthio group having 6 to 12 carbon atoms, an alkylsulfoxido group having 1 to 4 carbon atoms, an alkylsulfonyl group having 1 to 4 carbon atoms or a heterocyclic group.

3. The method of claim 2, said compound represented by formula 1a is added to the silver halide emulsion in an amount of from $1\times10^{-4}$ mg to $1\times10^{-2}$ mg per mol of silver halide.

4. The method of claim 1 wherein said compound represented by formula 1 is a compound represented by formula 1b,

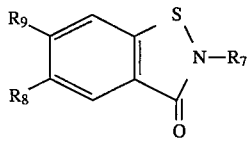

(1b)

wherein $R_7$ is the same as $R_1$ defined in Formula 1; $R_8$ and $R_9$ are each independently a hydrogen atom, an alkyl group having 1 to 4 carbon atoms, an alkoxyl group having 1 to 4 carbon atoms, a halogen atom, a nitro group or a cyano group.

5. The method of claim 4, wherein said compound represented by formula 1b is added to the silver halide emulsion in an amount of from $5\times10^{-4}$ mg to 50 mg per mol of silver halide.

6. The method of claim 1, wherein said compound represented by formula 1 is added with silver halide fine grains to said silver halide emulsion.

7. The method of claim 6, wherein said silver halide fine grains are silver iodide fine grains.

8. The method of claim 1, wherein said silver halide grains are tabular grains having an aspect ratio of 2.0 or more.

9. The method of claim 8, said aspect ratio of said tabular grains is within the range of from 2.2 to 8.0.

10. The method of claim 1, wherein said selenium compound is an isoselenocyanate, a selenourea, a selenoketone, a selenoamide, a selenocarbonic acid, a selenoester, a diacylselenide, a selenophosphate, a phosphinselenide or a colloidal metal selenium.

11. The method of claim 1, wherein said selenium compound is a compound represented by formula 2 or formula 3, $$Z_1-\overset{\overset{\displaystyle Se}{\|}}{C}-Z_2 \qquad (2)$$

wherein $Z_1$ and $Z_2$ are each independently an alkyl group, an alkenyl group, an aralkyl group, an aryl group, a heterocyclic group, an $-NR_1(R_2)$ group, an $-OR_3$ group or an $-SR_4$ group, in which $R_1$, $R_2$, $R_3$ and $R_4$ are each independently a hydrogen atom, an alkyl group, an aralkyl group, an aryl group, a heterocyclic group or a acyl group;

$$Z_4-\overset{\overset{\displaystyle Z_3}{|}}{\underset{\underset{\displaystyle Z_5}{|}}{P}}=Se \qquad (3)$$

wherein $Z_3$, $Z_4$ and $Z_5$ are each independently a straight or branched chain alkyl group, an alkenyl group, an alkinyl group, an aralkyl group, an aryl group, a heterocyclic group, an $-OR_7$ group, an $-NR_8(R_9)$ group, an $-SR_{10}$ group an $-SeR_{11}$ group, a halogen atom or a hydrogen atom, in which $R_7$, $R_{10}$ and $R_{11}$ are each a straight chain or branched chain alkyl group, an alkenyl group, an alkinyl group, an aralkyl group, an aryl group, a heterocyclic group, a hydrogen atom or a cation; and $R_8$ and $R_9$ are each selected from a group consisting of straight chain or branched chain alkyl group, an alkenyl group, an alkinyl group, an aralkyl group, an aryl group, a heterocyclic group, a hydrogen atom.

* * * * *